US008294631B2

(12) United States Patent
Croston

(10) Patent No.: US 8,294,631 B2
(45) Date of Patent: Oct. 23, 2012

(54) ANTENNA WITH A BENT PORTION

(75) Inventor: Roy Phillip Croston, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 763 days.

(21) Appl. No.: 12/458,323

(22) Filed: Jul. 8, 2009

(65) Prior Publication Data

US 2011/0006964 A1 Jan. 13, 2011

(51) Int. Cl.
*H01Q 9/16* (2006.01)

(52) U.S. Cl. ..... 343/806; 343/860; 343/864

(58) Field of Classification Search ..... 343/806, 343/860, 864, 793
See application file for complete search history.

(56) References Cited

U.S. PATENT DOCUMENTS

| | | | | |
|---|---|---|---|---|
| 1,708,515 | A | 4/1929 | Meissner | |
| 2,387,116 | A | 10/1945 | Bruce | |
| 2,462,898 | A * | 3/1949 | Chesus et al. | 342/429 |
| 2,750,590 | A | 6/1956 | Phelps | |
| 2,761,140 | A | 8/1956 | Ashton | |
| 3,074,064 | A | 1/1963 | Pickles | |
| 3,082,422 | A | 3/1963 | Watkins | |
| 3,680,147 | A | 7/1972 | Redlich | |
| 3,803,621 | A | 4/1974 | Britt | |
| 3,875,572 | A | 4/1975 | Kay | |
| 4,122,447 | A | 10/1978 | Kawai et al. | |
| 4,587,525 | A | 5/1986 | Parsons et al. | |
| 6,947,007 | B1 | 9/2005 | Rohde et al. | |
| 6,987,483 | B2 | 1/2006 | Tran | |
| 7,903,041 | B2 * | 3/2011 | LeVan | 343/788 |

* cited by examiner

*Primary Examiner* — Tan Ho
(74) *Attorney, Agent, or Firm* — Buchanan Ingersoll & Rooney PC

(57) ABSTRACT

An exemplary antenna system for an electromagnetic wave includes a conductor having a first portion and a second bent portion. The exemplary antenna system includes a first transformer connected to the second bent portion and configured to invert current of the second bent portion relative to current received from the first portion. An exemplary method for conducting an electromagnetic signal includes conducting an electromagnetic signal through a first portion and a second bent portion of a conductor. The exemplary method includes inverting current of the signal of the second bent portion relative to current received from the first portion. A wave created by current of the first portion can be added to a wave created by current of the second bent portion.

18 Claims, 2 Drawing Sheets

ANTENNA WITH A BENT PORTION

FIELD

An antenna system and associated method for an electromagnetic wave are disclosed.

BACKGROUND

An electric dipole antenna is capable of generating electromagnetic (EM) waves. A dipole antenna can consist of a piece of open wire which carries current. The current in an antenna oscillates at the frequency of transmission. A Hertzian dipole is a type of electric dipole that has a length much smaller than the wavelength of radiation.

Low frequency radio propagation can be used to reduce the effects (e.g. absorption) of structures (e.g. walls) on radio communications. To provide higher signal strength for lower frequency radio propagation, an antenna can be configured with increased length (e.g. 40 m for a ¼ wave monopole antenna at 1.8 MHz). Such a length inhibits portable operation (e.g. by one person in an urban environment) of a low frequency antenna system. Reducing the size of the antenna can lower the radiation resistance and efficiency. For example, a 1 m monopole antenna can have a radiation resistance of approximately 0.01 Ohm and an efficiency of approximately 0.01%.

SUMMARY OF DISCLOSURE

An exemplary antenna system for an electromagnetic wave includes a conductor having a first portion and a second bent portion. The exemplary antenna system includes a first transformer connected to the second bent portion and configured to invert current of the second bent portion relative to current received from the first portion. A wave created by current of the first portion can be added to a wave created by current of the second bent portion.

An exemplary antenna system for an electromagnetic wave includes means for conducting a signal, the means for conducting having a first portion and a second bent portion. The exemplary antenna system includes means for inverting a current of the second bent portion relative to current received from the first portion. A wave created by current of the first portion can be added to a wave created by current of the second bent portion.

An exemplary method for an electromagnetic wave includes conducting an electromagnetic signal through a first portion and a second bent portion of a conductor. The exemplary method includes inverting current of the signal of the second bent portion relative to current received from the first portion. A wave created by current of the first portion can be added to a wave created by current of the second bent portion.

BRIEF DESCRIPTION OF THE DRAWING FIGURES

Other objects and advantages of the present disclosure will become apparent to those skilled in the art upon reading the following detailed description of exemplary embodiments, in conjunction with the accompanying drawings, in which like reference numerals have been used to designate like elements, and in which.

As will be realized, different embodiments are possible, and the details herein are capable of modification in various respects, all without departing from the scope of the claims. Accordingly, the drawings and descriptions of exemplary embodiments are to be regarded as illustrative in nature and not as restrictive.

DETAILED DESCRIPTION OF EXEMPLARY EMBODIMENTS

Figure 1:
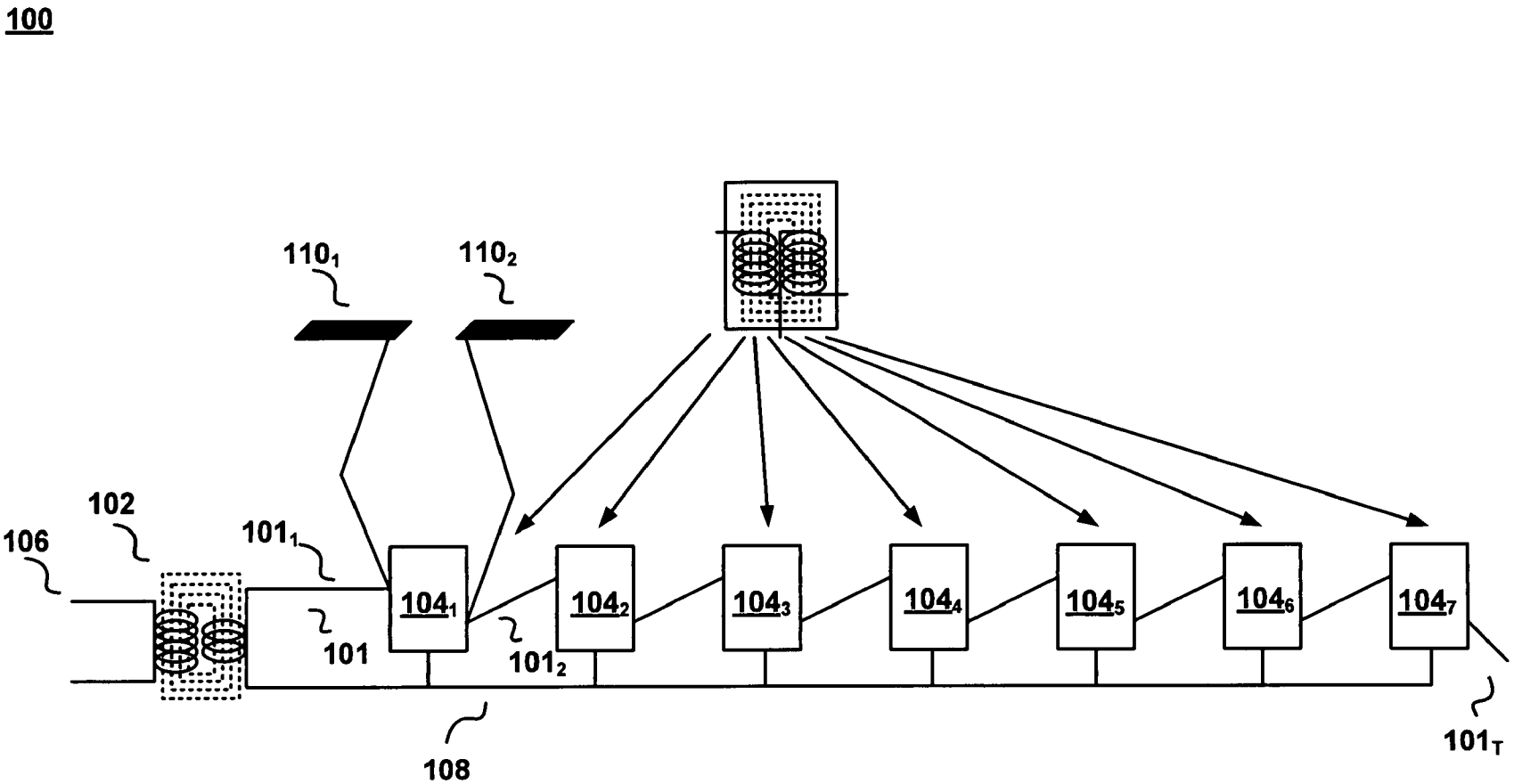
FIG. 1 illustrates schematically an exemplary embodiment of an antenna.

FIG. 1 illustrates an exemplary antenna system 100 for an electromagnetic wave. The antenna system 100 includes a conductor 101 having a first portion $\mathbf{101}_1$ and a second bent portion $\mathbf{101}_2$. The conductor 101 can comprise any suitable conductive material(s). The antenna system 100 includes a first transformer $\mathbf{104}_1$ connected to the second bent portion $\mathbf{101}_2$. The transformer $\mathbf{104}_1$ is configured to invert current of the second bent portion relative to current received from the first portion. A wave created by current of the first portion can be added to a wave created by current of the second bent portion.

For ease of illustration, portion $\mathbf{101}_1$ is described as a first portion of the conductor 101 and portion $\mathbf{101}_2$ is described as a second portion of the conductor 101. It is to be understood that the portions do not have to be immediately successive to constitute the first and second portions and may be connected by one or more transformers therebetween.

The antenna system 100 can include an impedance matching transformer 102 configured to couple an electrical input and/or output for the antenna system. For example, impedance matching transformer 102 is shown in FIG. 1 coupled to a connection 106 for connecting the antenna system 100 to a transmitter and/or receiver. The first transformer $\mathbf{104}_1$ can be part of a plurality of inverting transformers $\mathbf{104}_x$ coupled to various portions of the conductor 101, where "x" can be any positive integer. The example of FIG. 1. illustrates seven transformers $\mathbf{104}_1$-$\mathbf{104}_7$. The impedance matching transformer 102 and/or the inverting transformers $\mathbf{104}_x$ can be toroidal, for example. One or more inverting transformers $\mathbf{104}_x$ can be coupled to a reference potential 108 (e.g. ground). The length of connections between inverting transformers 104 can be varied, as desired. For example, a uniform length can be used or a length which varies from each transformer can be used.

In exemplary embodiments, the conductor 101 can include a terminating portion $\mathbf{101}_T$, which is connected on one end to the last transformer in a series of transformers, but is not physically connected to another transformer. In the example of FIG. 1, the terminating portion $\mathbf{101}_T$ is connected to transformer $\mathbf{104}_7$ because it is the last transformer in the series of transformers $\mathbf{104}_1$-$\mathbf{104}_7$. In exemplary embodiments with a single transformer, the terminating portion is physically connected only to one side of the single transformer, and the other side of the single transformer is connected to an electrical input and/or output.

If an antenna is shortened by bending (e.g. looping back) of a conductor, a resulting current can cancel an EM field by generating a current in an opposite direction within the bent portion of the antenna. Exemplary embodiments use the transformers $\mathbf{104}_x$ (e.g. a toroidal transformer) associated with each bend in the conductor 101 to invert the direction of the current in a succeeding portion of the conductor. When the portions are short (e.g. on the order of 1 m or less) and the conductor has multiple bends, the current can act to add together the respective EM field from each portion.

In an embodiment having a conductor 101 with a physical length of 1 meter and 7 bends (e.g. the conductor illustrated in FIG. 1), an effective length of the antenna system can be 8 meters. Exemplary embodiments can have as few as a single bent portion $\mathbf{101}_2$ with a corresponding inverting transformer $\mathbf{104}_1$. The effective impedance can be increased so that the conductor behaves much like a larger antenna. By making the radiation resistance much larger than the electrical (i.e. dissipative) resistance, the radiation efficiency of the antenna can also increase. This can provide reduced link loss through an increase in antenna gain, and communications over a larger range can be more reliable.

In an exemplary implementation having an equivalent length of approximately ¼ wavelength, radiation resistance can be approximately 25 ohms and the efficiency approximately 40%.

Exemplary embodiments of the antenna system 100 can include an optional capacitive element including a first end $\mathbf{110}_1$ and a second end $\mathbf{110}_2$, wherein the first end $\mathbf{110}_1$ is connected to the first portion $\mathbf{101}_1$, and the second end $\mathbf{110}_2$ is connected to the second bent portion $\mathbf{101}_2$. Each end can include a respective metal plate such that the metal plates collectively function as a capacitor. The capacitive element can shape an electric field between the first end $\mathbf{110}_1$ and the second end $\mathbf{110}_2$.

While FIG. 1 shows the capacitive element coupled between the ends of transformer $\mathbf{104}_1$, other exemplary embodiments can include respective capacitive elements (e.g. capacitors) connected to one or more additional or different transformers in a similar manner to the example of the capacitive element illustrated in FIG. 1.

Exemplary embodiments of the present disclosure are configured such that current flowing in the conductor 101 can establish a magnetic dipole. The magnetic dipole can generate a magnetic field that radiates in free space with a far field similar to that for a full length antenna. However, an accompanying electric field can be essentially cancelled between elements. In exemplary embodiments, the capacitive element can be included to compensate for the cancellation of the electric field. This can establish an electric dipole to accompany the magnetic dipole. As a result, an electromagnetic field similar to that of a dipole can be generated. When low frequency electromagnetic waves (e.g. low frequency radio waves) are conducted through the antenna system, the antenna system can approximate a Hertzian dipole.

Figure 2:
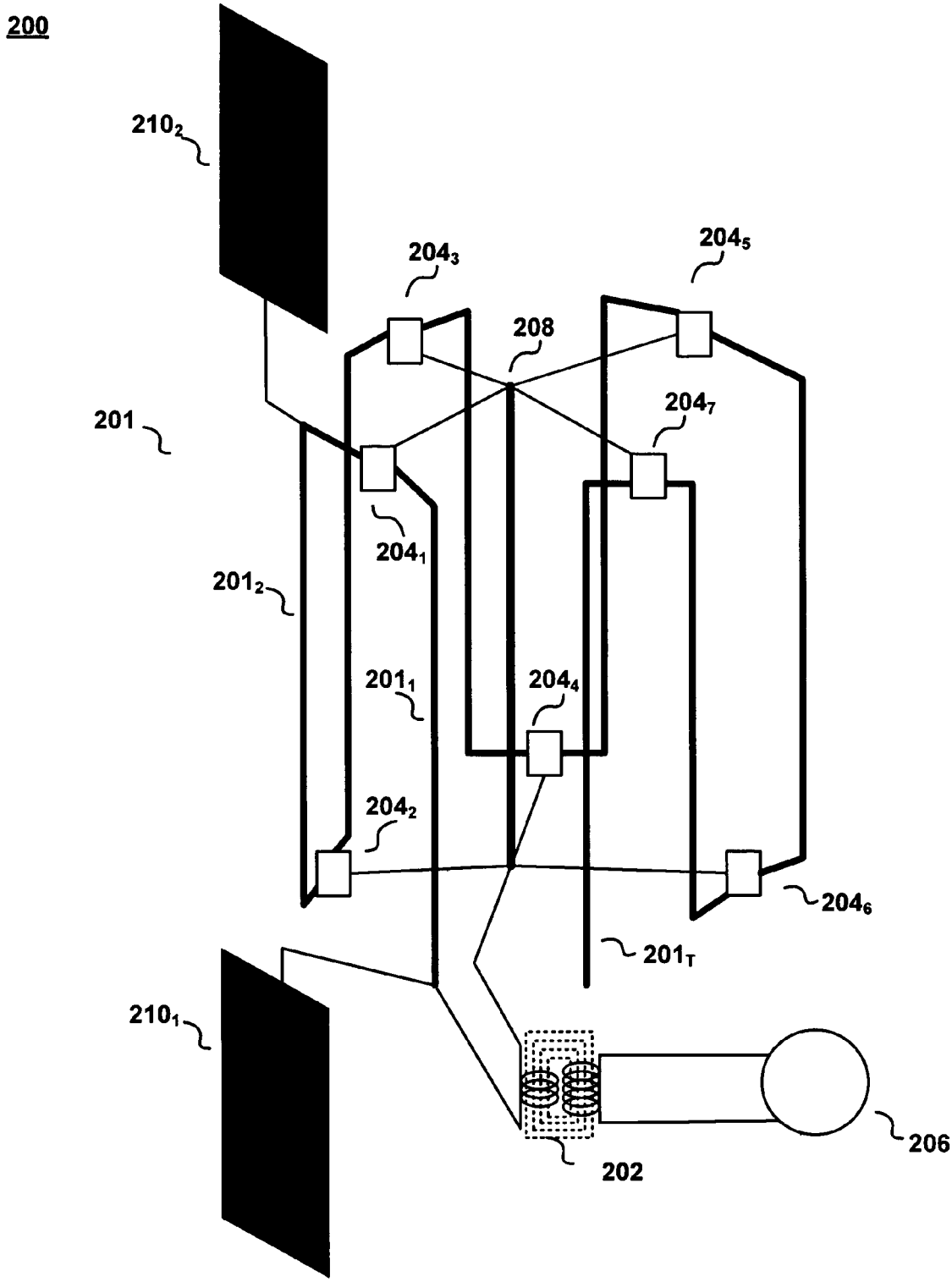
FIG. 2 illustrates an exemplary layout of FIG. 1.

FIG. 2 illustrates an exemplary layout of the exemplary FIG. 1 antenna system 100 and is labeled as antenna system 200. The antenna system 200 includes a conductor 201 having a first portion $\mathbf{201}_1$ and a second bent portion $\mathbf{201}_2$. The conductor 201 can comprise any suitable conductive material(s). The antenna system 200 includes a first transformer $\mathbf{204}_1$ connected to the second bent portion $\mathbf{201}_2$. The transformer $\mathbf{204}_1$ is configured to invert current of the second bent portion relative to current received from the first portion.

The antenna system 200 includes an impedance matching transformer 202 and a plurality of inverting transformers $\mathbf{204}_x$ coupled to the conductor 201. The conductor 201 includes portions (e.g. the first portion $\mathbf{201}_1$ and the second bent portion $\mathbf{201}_2$) that are bent relative to each other. Each of the inverting transformers $\mathbf{204}_x$ include connections between portions of conductor 201 in addition to a connection to a reference potential, which can be provided through grounding pole 208.

Each transformer $\mathbf{204}_x$ can be connected to a respective bent portion and configured to invert current of the respective bent portion relative to current received from a respective portion to which it is connected. The impedance matching transformer 202 and/or the inverting transformers 204 can be, for example, toroidal.

The antenna system 200 has a connection 206 for connecting the antenna system 200 to a transmitter and/or receiver. Each inverting transformer $\mathbf{204}_x$ is coupled to the grounding pole 208, which is used as the reference potential in the example of FIG. 2. In the exemplary embodiment of FIG. 2, inverting transformers with evenly numbered subscripts (e.g. $\mathbf{204}_2$, $\mathbf{204}_4$, $\mathbf{204}_6$) are connected in common to a first point (e.g. end) of the grounding pole 208. Inverting transformers with odd numbered subscripts (e.g. $\mathbf{204}_1$, $\mathbf{204}_3$, $\mathbf{204}_5$, $\mathbf{204}_7$) are connected in common to a second point (e.g. end) of the grounding pole. The length of some or all of the portions can be substantially equal to the length of the grounding pole 208.

In exemplary embodiments, the conductor 201 can include a terminating portion $\mathbf{201}_T$, which is connected on one end to the last transformer in a series of transformers, but is not physically connected to another transformer. In the example of FIG. 2, the terminating portion $\mathbf{201}_T$ is connected to transformer $\mathbf{204}_7$ because it is the last transformer in the series of transformers $\mathbf{204}_1$-$\mathbf{204}_7$. In exemplary embodiments, the terminating portion is left unconnected to any other elements other than the last transformer (e.g. $\mathbf{204}_7$).

FIG. 2 is to be viewed with a three-dimensional perspective and illustrates the conductor 201 located about (e.g. surrounding or partially surrounding) the grounding pole. For example, in the perspective of FIG. 2, grounding pole 208 is surrounded by the transformers $\mathbf{204}_x$.

Exemplary embodiments can have any number of inverting transformers and bent portions. At least part of the second bent portion of the conductor can be bent substantially or exactly 180 degrees relative to at least part of the first portion of the conductor. In some embodiments, the first portion can have a first bend which is substantially or exactly 90 degrees and the second bent portion can have a second bend which is substantially or exactly 90 degrees. However, bends of any desired angle can be used to achieve any desired effect on the EM wave that can be transmitted or received. A wave created by current of the first portion can be added to a wave created by current of the second bent portion.

Exemplary embodiments of the antenna system 200 can include a capacitive element including a first end $\mathbf{210}_1$ and a second end $\mathbf{210}_2$, wherein the first end $\mathbf{210}_1$ is connected to the first portion $\mathbf{201}_1$, and the second end $\mathbf{210}_2$ is connected to the second bent portion $\mathbf{201}_2$. Each end $\mathbf{210}_1$, $\mathbf{210}_2$ can include a respective metal plate such that the metal plates together can collectively function as a capacitor.

In an exemplary embodiment of the capacitive element, first end $\mathbf{210}_1$ can be spaced apart from the second end $\mathbf{210}_2$ by a distance as long as or longer than a portion (e.g. first portion $\mathbf{201}_1$) of the conductor.

An exemplary method for conducting (e.g. transmitting or receiving) an electromagnetic wave includes conducting an electromagnetic signal through a first portion (e.g. $\mathbf{101}_1$) and a second bent portion (e.g. $\mathbf{101}_2$) of a conductor 101. The exemplary method also includes inverting current (e.g. via a transformer $\mathbf{204}_1$) of the signal of the second bent portion relative to current received from the first portion. Other embodiments of the method can include inverting the current for the second bent portion for a third bent portion relative to current received from the second bent portion. Exemplary methods can perform any steps corresponding to the features that any of the constituent elements of the exemplary antenna systems can perform.

Another exemplary method for conducting an electromagnetic wave includes capacitively coupling the first portion to the second bent portion. Using the example of FIG. 1, capacitive coupling can occur between the first end $\mathbf{110}_1$ and second end $\mathbf{110}_2$.

An exemplary antenna system for an electromagnetic wave can include means for conducting a signal, the means for conducting having a first portion and a second bent portion. The means for conducting can include, for example, a conductor as described above and as illustrated as conductors 101 and 201 in FIGS. 1 and 2. The exemplary antenna system can also include means for inverting a current of the second bent portion relative to current received from the first portion such that a wave created by current of the first portion can be added to a wave created by current of the second bent portion.

The means for inverting can include, for example, at least one inverting transformer as described above and as illustrated as transformers $\mathbf{104}_x$ and $\mathbf{204}_x$ in FIGS. 1 and 2.

Exemplary embodiments can include or be coupled to a signal handler. The signal handler can include at least one of a transmitter, a receiver, and transceiver which is connected to connection 106 or 206. The signal handler can include, for example, a processor configured to process signals to be sent and/or received. The signal handler can transmit and/or receive signals, for example radio signals, through the connection 106 or 206. The signals can be low frequency signals, for example signals with a frequency of less than 2 Mhz, more particularly less than 1 Mhz, and even more particularly less than 500 khz.

The above description is presented to enable a person skilled in the art to make and use the systems and methods described herein, and is provided in the context of a particular application and its requirements. Various modifications to the embodiments will be readily apparent to those skilled in the art, and the generic principles defined herein may be applied to other embodiments and applications without departing from the spirit and scope of the claims. Thus, there is no intention to be limited to the exemplary embodiments shown, but rather the intent is to be accorded the widest scope consistent with the principles and features disclosed herein.

What is claimed is:

1. An antenna system for an electromagnetic wave, the system comprising:

a conductor having a first portion and a second bent portion; and a first transformer connected to the second bent portion and configured to invert current of the second bent portion relative to current received from the first portion such that a wave created by current of the first portion is added to a wave created by current of the second bent portion.

2. The system of claim 1, wherein the first transformer is toroidal.

3. The system of claim 1, wherein at least part of the second bent portion is bent substantially 180 degrees relative to at least part of the first portion.

4. The system of claim 1, wherein the first transformer is connected to a reference potential.

5. The system of claim 1, comprising a capacitive element including a first end connected to the first portion and a second end connected to the second bent portion.

6. The system of claim 1, comprising:

an impedance matching transformer coupled as an electrical input/output for the system.

7. The system of claim 1, comprising:

a third bent portion; and a second transformer connected to the third bent portion and configured to invert current of the third bent portion relative to current received from the second bent portion.

8. The system of claim 1, wherein the first portion has a first bend which is substantially 90 degrees, and the second bent portion has a second bend which is substantially 90 degrees.

9. The system of claim 7, comprising:

a ground connection;

wherein the first transformer and the second transformer are connected to the ground connection at a first point and a second point, respectively, and the first point and the second point are spaced apart from each other in a lengthwise direction on the ground connection.

10. The system of claim 9, wherein the grounding connection is a grounding pole having a length substantially equal to the length of the second bent portion.

11. The system of claim 10, wherein the conductor is located about the grounding pole.

12. The system of claim 9, comprising at least one other transformer;

wherein the first point is a common connection for the first transformer and the at least one other transformer.

13. An antenna system for an electromagnetic wave, the system comprising:

means for conducting an electromagnetic signal, the means for conducting having a first portion and a second bent portion; and means for inverting a current of the second bent portion relative to current received from the first portion such that a wave created by current of the first portion is added to a wave created by current of the second bent portion.

14. A method for an electromagnetic wave, comprising:

conducting an electromagnetic signal through a first portion and a second bent portion of a conductor; and inverting current of the signal of the second bent portion relative to current received from the first portion such that a wave created by current of the first portion is added to a wave created by current of the second bent portion.

15. The method of claim 14, comprising:

inverting the current for the second bent portion for a third bent portion relative to current received from the second bent portion.

16. The method of claim 14, comprising:

capacitively coupling the first portion to the second bent portion.

17. The method of claim 14, wherein the conducting of the electromagnetic signal comprises transmitting the electromagnetic signal through the first portion and the second bent portion of the conductor.

18. The method of claim 14, wherein the conducting of the electromagnetic signal comprises receiving the electromagnetic signal through the first portion of the second bent portion of the conductor.

* * * * *